US005379732A

United States Patent [19]

Mavinahally et al.

[11] Patent Number: 5,379,732

[45] Date of Patent: Jan. 10, 1995

[54] CONTINUOUSLY VARIABLE VOLUME SCAVENGING PASSAGE FOR TWO-STROKE ENGINES

[76] Inventors: Nagesh S. Mavinahally; Pushpalatha S. Mavinahally, both of 11592 Yarmouth Ave., Granada Hills, Calif. 91344

[21] Appl. No.: 151,177

[22] Filed: Nov. 12, 1993

[51] Int. Cl.[6] ..... F01P 1/04

[52] U.S. Cl. ..... 123/73 AA; 123/73 PP

[58] Field of Search ..... 123/73 R, 73 AA, 73 PP

[56] References Cited

U.S. PATENT DOCUMENTS

| | | | |
|---|---|---|---|
| 4,776,303 | 10/1988 | Hundertmark | 123/73 PP |
| 4,809,648 | 3/1989 | Luo | 123/73 AA |
| 4,829,940 | 5/1989 | Okazaki et al. | 123/73 AA |
| 5,027,759 | 7/1991 | Luo | 123/73 PP |
| 5,090,363 | 2/1992 | Duret | 123/73 PP |

*Primary Examiner*—E. Rollins Cross
*Assistant Examiner*—M. Macy
*Attorney, Agent, or Firm*—Steven J. Rosen

[57] ABSTRACT

A variable volume transfer duct for maintaining an optimum volume of buffer gas in the transfer duct of a two-stroke engine during operation in order to minimize short circuit loss of fresh charge at all load levels during engine operation. The variable volume transfer duct that has two pieces, a top and a bottom duct wherein the bottom duct is aligned with and slidably disposed within the upper duct. Control means are provided for raising and lowering of the bottom duct to vary the transfer duct volume accordingly. A control means controls recirculates exhaust gas, or the secondary air, as buffer gas that fills the top of the transfer passage and regulates the buffer gas according to engine load conditions such that it provides a larger amount at higher loads and a lesser quantity at lighter loads.

10 Claims, 7 Drawing Sheets

1A

CONTINUOUSLY VARIABLE VOLUME SCAVENGING PASSAGE FOR TWO-STROKE ENGINES

FIELD OF INVENTION

This invention relates to scavenging passages, also referred to as transfer passages, for two-stroke internal combustion engines and in particular to variable volume transfer passages for scavenging in two-stroke internal combustion engines.

BACKGROUND OF THE INVENTION

This invention relates to a design for two-stroke engines that reduces the exhaust pollutants, short circuit loss of fresh charge, promote lean burning ability of the engine, and stratify the charge and thus improve the overall emission and efficiency characteristics of the two-stroke type internal combustion engine. Two-stroke engines are known for their simplicity and high specific output. However, they have drawbacks of poor emissions and efficiency characteristics. It is estimated that fuel consumption and hydrocarbon emissions of two-stroke engines are 1.5 to 2.0 times and 10–20 times that of equivalent four-stroke engines respectively. Some small utility engines produce up to 50 times the pollution of trucks, per horsepower per hour. High unburned hydrocarbon emissions arise because in a carburetted two-stroke engine the scavenging process is carried out by the fresh mixture of air and fuel. Some of the air-fuel mixture mixes with the residual exhaust gas as it scavenges the cylinder and a small fraction of the charge is lost due to short circuiting. The net effect is that 25–40% of the charge may be wasted resulting in high fuel consumption and high levels of unburned hydrocarbons. In order to eliminate the problem, it has been proposed by Nagesh S. Mavinahally, through his patent application Ser. No. 08/120,545 and disclosure documents 338055 and 336827 to additionally provide a buffer gas in the transfer passages/ducts to enter the cylinder during the scavenging process ahead of fresh charge to prevent or minimize short circuit loss of fresh charge into the atmosphere. It has been demonstrated by him and others that the concept of providing buffer gas can minimize the loss of fresh charge. The buffer gas enters the upper part of the transfer duct displacing the fresh charge remaining from the previous cycle into the crankcase chamber. The amount of buffer gas that is retained in the duct is dependent upon the duct volume and the gas allowed to flow into the ducts. But the volume of the duct depends on the length of the duct from the port to the crankcase chamber. However, it is experienced that the amount of buffer gas introduced into the transfer duct is to be regulated and is dependent on the engine load. With a fixed volume of the transfer duct, as the amount of buffer gas flow is increased to an amount more than the volume of the transfer duct the excess buffer gas simply mixes with the fresh charge diluting it in the crankcase chamber. It is experienced that excessive dilution is detrimental to engine performance at lower loads, which may increase the emission and deteriorate efficiency. It is understandable that more amount of buffer gas is required at higher loads due to larger percentage of short circuit loss and converse is true at lighter loads. It is therefore important to have an optimum amount of buffer gas in the transfer duct.

The amount of buffer gas that remain in situ between the live crankcase content of live mixture and the closed transfer/auxiliary scavenging port to the cylinder is an important factor. It is dependent on the volume of the transfer passage. With its given fixed volume in more conventional engines, increasing the introduction of buffer gas does not guarantee its effectiveness, unless it remains in the transfer duct. An amount greater than the duct's volume simply mixes with the live mixture diluting it in the crankcase chamber.

SUMMARY OF THE INVENTION

The present invention is a variable volume transfer duct for maintaining an optimum volume of buffer gas in the transfer duct of a two-stroke engine operation in order to minimize short circuit loss of fresh charge at all load levels during engine operation. The present invention provides a control means to control recirculated exhaust gas, or the secondary air, hereinafter referred to as buffer gas, that fills the top of the transfer passage. The control means regulates the buffer gas according to engine load conditions such that it provides a larger amount of buffer gas at higher engine loads and a lesser quantity of buffer gas at lighter engine loads. The control means is constructed to flow the buffer gas through passages in the piston or alternatively directly from the atmosphere through a regulating valve and through non-return valves.

One particular embodiment of the present invention provides a variable volume transfer duct that has two pieces, a top and a bottom duct. The top duct is integral with the cylinder block and the bottom duct aligned with and slidably disposed within the upper duct. Control means are provided for raising and lowering of the bottom duct to vary the transfer duct volume accordingly. One embodiment of the present invention provides for control means to slide the bottom duct which can be controlled from outside of an enclosed crankcase chamber through appropriate linkages which operate in conjunction with a carburetor valve and/or with a buffer gas controlling valve.

The present invention provides actuation means that in one embodiment provides a rack and pinion arrangement wherein the bottom duct has a geared rack on its outer surface and a pinion outside of the cylinder block which engages the rack through a window in the cylinder block. Rotation of the pinion, against a spring, through appropriate linkages is used to raise and lower the bottom duct position with respect to the fixed top duct. The pinion is housed in a leak proof box to prevent the loss of pressure and fresh charge from the crankcase. An alternative embodiment provides a slotted member that engages a pin on the bottom duct. The bottom duct can be lowered or raised with the movement of the slotted member which is fixed to a spring loaded pin housed in the box.

The pin in turn can be rotated by means of another member which is outside of the box. Preferably the spring is used to keep the bottom duct in a top position and therefore the actuation means preferably applies a force to lower the bottom duct. Another more particular embodiment provides a lever may be connected to a carburetor valve through appropriate linkages such as to raise and lower the bottom duct in conjunction with the opening or closing of valve in the carburetor. Another valve controlling the flow of buffer gas may be linked to duct lever to function in conjunction with it.

Because two-stroke engines may have one transfer passage opposite to exhaust port as in the case of a cross scavenged engine or two passages on either side of exhaust or a third auxiliary scavenging ports opposite to exhaust, the present invention can be used either in one auxiliary scavenging passage, two transfer passages, a single transfer passage, or more than two passages as the case may be.

Therefore, one objective of the present invention is to provide an optimum amount of buffer gas in a transfer duct of a two-stroke internal combustion engine. Another objective is to provide a variable volume transfer passage or duct for scavenging in two-stroke internal combustion engines. Among the advantages provided by the present invention is the ability to maintain an optimum volume of buffer gas in the transfer duct and to minimize the short circuit loss of fresh charge at all loads of engine operation. Another advantages of the present invention is the ability to prevent excess buffer gas from mixing with the fresh charge which would then dilute the fresh charge in the crankcase chamber which is detrimental to engine performance at lower loads and which may increase the emissions and deteriorate efficiency of the engine.

DESCRIPTION OF THE INVENTION

A two-stroke crankcase compression engine having a continuously variable volume transfer duct constructed in accordance with an embodiment of the invention is illustrated in the FIGS. 1 through 10. FIGS. 4, 5, 6, 7, 8 and 9 illustrate in detail the location of each duct and the linkages to control the duct position. A more detailed description of the engine's operation in conjunction with exhaust gas recirculation into the top of the transfer duct and also using air from the atmosphere through the passages in the piston are available in U.S. patent application Ser. No. 08/120,545 and disclosure documents 338055 and 336827.

As mentioned in the references above, a piston port controlled selective exhaust gas recirculation is provided for a two-stroke engine and the like. The design minimizes exhaust pollutants and reduces the short circuit loss of fresh charge to the atmosphere. The objective of these designs is to selectively recirculate the exhaust gas by means of piston controlled port timing for the return of exhaust gas that is rich in unburnt hydrocarbons and other pollutants into the combustion chamber. Piston controlled port timing retains the simplicity of the two-stroke engine. Recirculation is selective on account of the ability of the design to have port timing best suited for maximum recirculation of exhaust gas that is rich in pollutants. In another design only air is inducted into the top of the transfer passage through the piston controlled ports to reduce the exhaust pollutants. The primary object of this invention is to provide a variable volume transfer passage in two-stroke engines.

Figure 1:
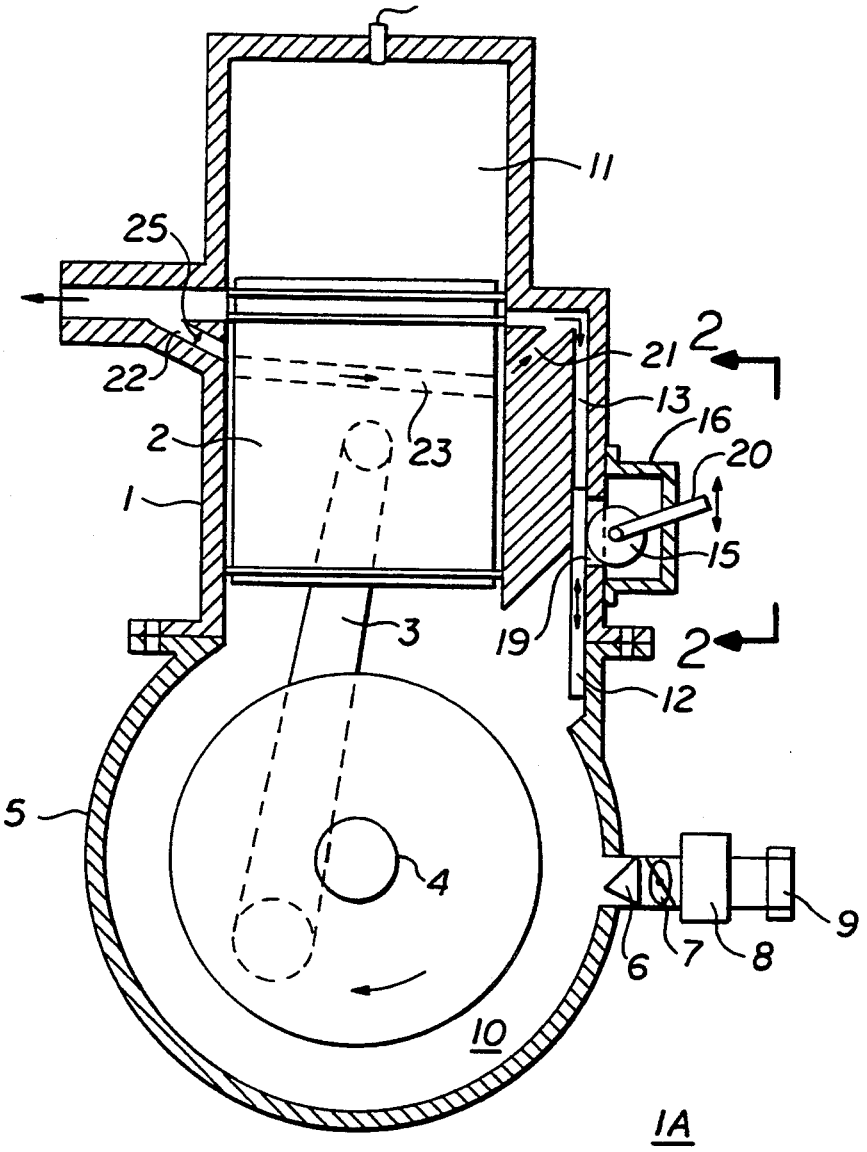
FIG. 1 is a sectional elevation of a two-stroke crankcase compression engine having a conventional reed valve induction system and a variable volume transfer duct constructed in accordance with one embodiment of the present invention wherein the piston is shown at a position where the recirculating piston port is beginning to open the recirculating passages for the flow of buffer gas and the bottom transfer duct is at its lower position.
Figure 2:
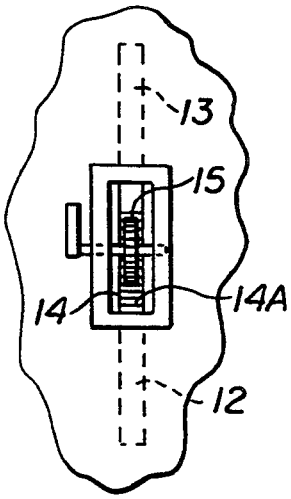
FIG. 2 is a portion of a side view showing the variable volume transfer duct as shown in FIG. 1.

FIG. 1 illustrates a two-stroke type internal combustion engine 1A having a cylinder block 1, a piston 2 connecting a rod 3 to translate reciprocating motion of the piston to a rotary motion in a crankshaft 4. Crankshaft 4 is housed in a crankcase 5. Crankcase 5 has a reed valve/non-return valve 6 at its inlet through which air and fuel enter the crankcase chamber 10. The induction system has a valve 7 which can be either butterfly valve or slide valve or any suitable type to regulate the flow of air-fuel mixture and air enters the carburetor 8 through an air filter 9.

The charge enters the combustion chamber 11 through a continuously variable volume transfer passage or transfer duct illustrated in FIG. 1, as a two piece duct having a bottom duct 12 and an upper duct 13, wherein the bottom duct is slidably disposed inside the top duct. Further referring to FIG. 2, the bottom duct 12 has a rack 14 with gear teeth **14*a* on the outer surface engaged to a pinion 15. The pinion 15 is housed inside a leak proof box 16. The pinion is mounted rigidly on a pin 17 and the pin 17 has a coiled spring 18, shown in FIG. 4, to keep the bottom duct in a raised position. The pinion 15 is inserted through a window 19 in the cylinder block 1. Force is essential to operate the variable volume transfer duct because of the coiled spring 18 that helps keep the bottom duct 12 in a raised position. The pin 17 can be rotated by means of a lever 20 attached to the outer end of the pin 17. The rotation of the pinion 15 will move the bottom duct 12 up or down accordingly. Thus, the length of the transfer duct can be varied by moving the lever 20**. The variation of the variable volume transfer duct length directly varies the volume of the transfer duct.

Figure 3:
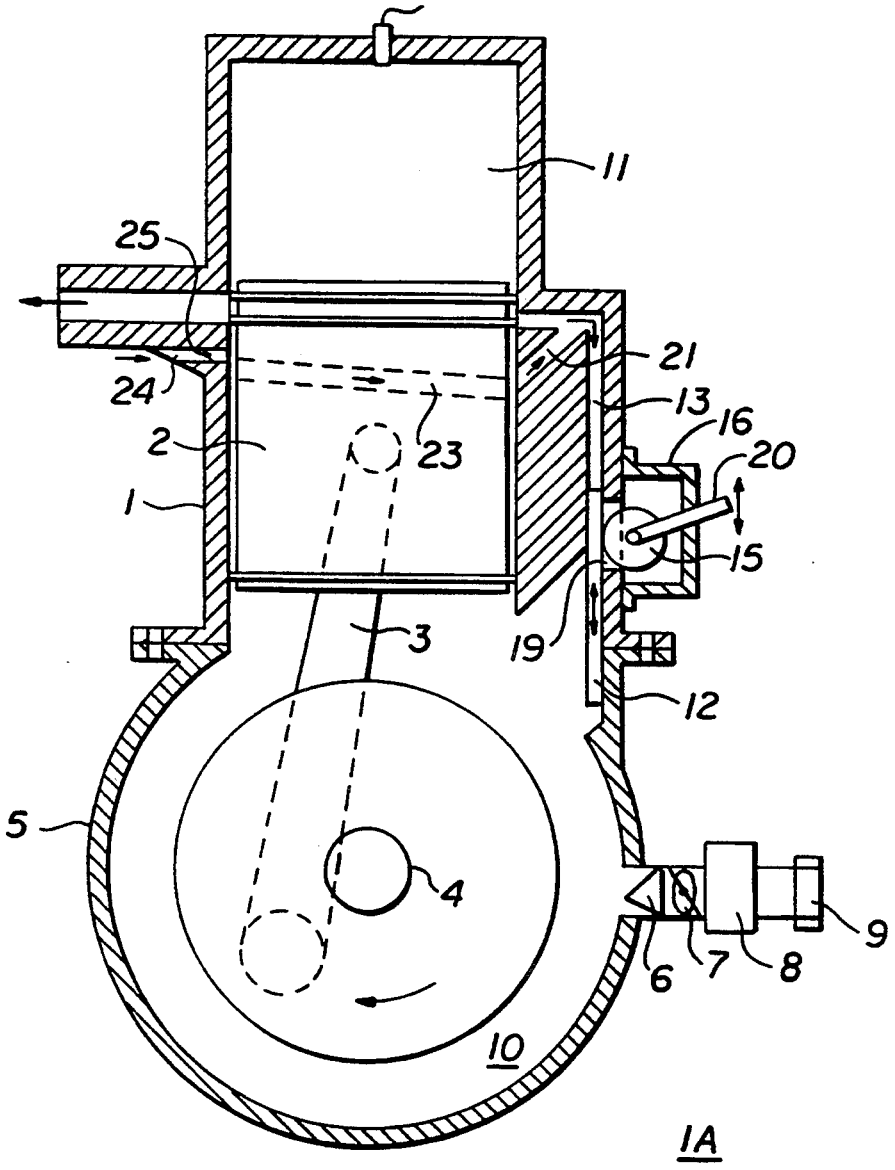
FIG. 3 is a sectional elevation illustrating an alternative embodiment of the present invention in which secondary air acts as a buffer gas that enters the top of the transfer duct through passages in the piston and non-return valves.
Figure 4:
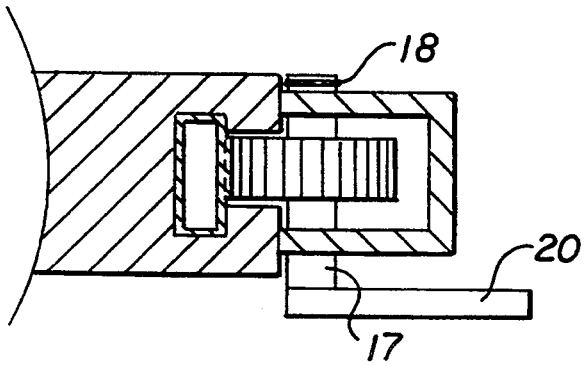
FIG. 4 is a sectional top view of FIG. 5, which shows the arrangement of the box, pinion, lever, and the bottom box engaged to the pinion.

The buffer gas, exhaust gas in FIG. 1, enters the top of the transfer duct at the top of upper duct 13 through passages 21 and 22 in the cylinder block 1 and through the passage 23 in the piston at an appropriate time during the upward stroke of the piston 2. An alternative embodiment, illustrated in FIG. 3, provides for fresh air to enter the top of upper duct 13 through the passages 21 and 24 in the cylinder block 1 and passage 23 in the piston. The flow of buffer gas may be regulated by an appropriate valve 25 at the inlet side of the buffer gas passages 24 which therefore regulates the quantity of the buffer gas flowing into the top duct 12 of the transfer duct. The valve 25 allows a greater amount of buffer gas at higher loads than at lower loads. This valve is essential to regulate the buffer gas volume according to the load.

In the case of a fixed volume transfer duct, it has observed that a larger amount of buffer gas is detrimental to the engine's performance at lighter loads. It is also reasoned that at higher engine outputs, buffer gas volume in excess of volume of the transfer duct will dilute the fresh live mixture in the crankcase chamber 10. In the embodied invention, the transfer duct volume is continuously variable according to the needs of the flow of buffer gas.

Appropriate design and linkages are illustrated to vary the volume of the transfer duct. The lever 20 may be connected to the carburetor valve 7 to vary the position of the bottom duct 12 with respect to the top duct 13. Therefore, the amount of buffer gas retained in the transfer duct can be controlled to prevent dilution of fresh charge in the crankcase chamber 10. At lighter loads, the length of the transfer duct is reduced to improve the flow of fresh charge from the crankcase chamber 10 to the combustion chamber 11. The regulating lever 20 may be connected to buffer gas regulating valve 25 and alternatively to both the carburetor valve 7 and the buffer gas regulating valve 25 such that all the three operate in conjunction with one another.

Figure 5:
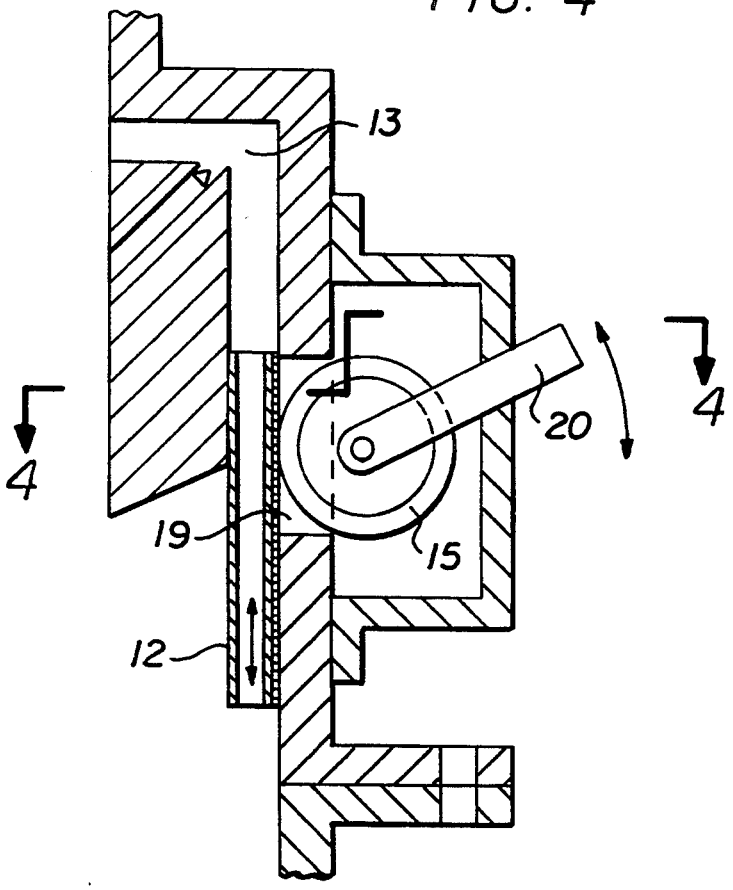
FIG. 5 is an enlarged partial sectional elevational view of the variable volume transfer ducts and the bottom duct at a lowered position engaged to the pinion as shown in the embodiments illustrated in FIGS. 1 and 3.
Figure 6:
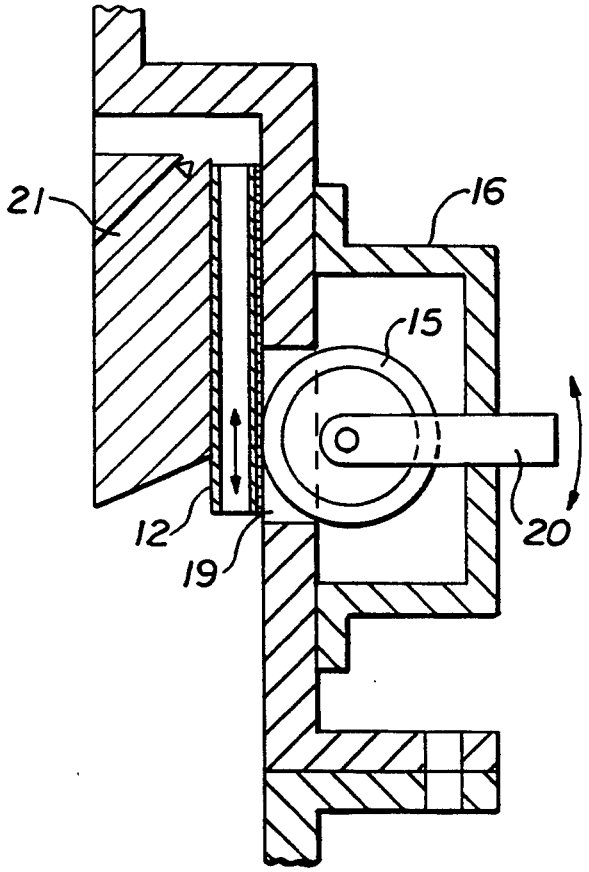
FIG. 6 is an enlarged-partial sectional elevational view of the variable volume transfer ducts and the bottom duct at a raised position engaged to the pinion as shown in the embodiments illustrated in FIGS. 1 and 3.
Figure 7:
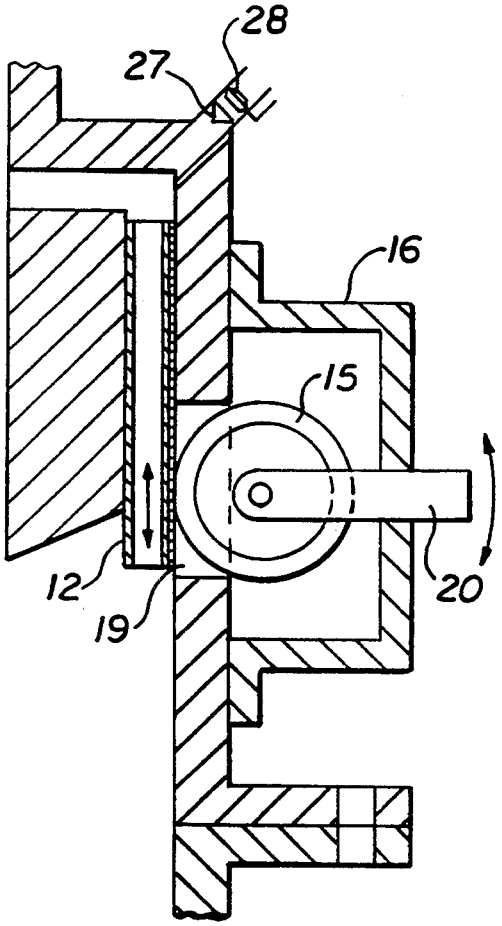
FIG. 7 is an enlarged partial sectional elevational view of the variable volume transfer ducts as shown in FIG. 6 with a non-return valve with a regulating valve attached at the upper part of the transfer duct to allow fresh air directly from the atmosphere.

FIGS. 4, 5, 6 and 7 illustrate in greater detail the arrangement of the rack 14, the pinion 15, and the bottom and upper ducts 12 and 13 respectively. FIG. 6 shows the bottom duct 12 in a raised position, wherein the duct volume is less than if the bottom duct was in a lowered position as shown in FIG. 5. FIG. 7 illustrates an alternative embodiment with a non-return valve 27 and a control valve 28 located on the upper part of the transfer duct. This embodiment of the present invention further provides means for varying the duct volume (as discussed above) which may be effectively used in such designs.

Figure 8:
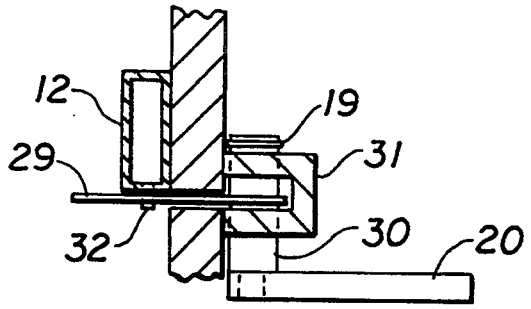
FIG. 8 is a top sectional view of an alternative actuation means to control the bottom duct position.
Figure 9:
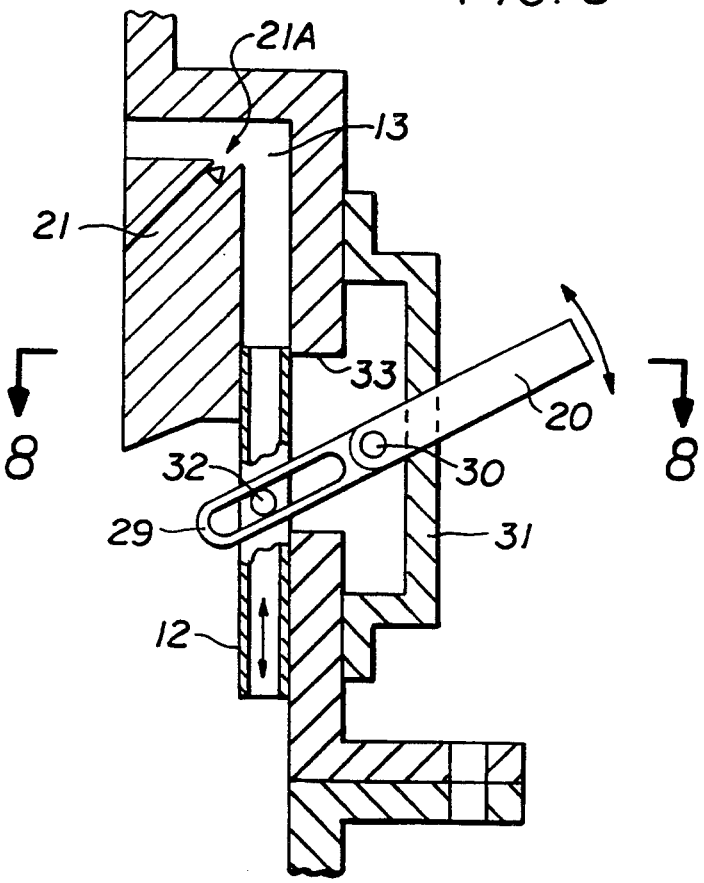
FIG. 9 is front sectional elevational view of the actuation means illustrated in FIG. 8 with the bottom duct at its lowered position.

FIGS. 8 and 9 illustrate an embodiment of the mechanism to control the position of the bottom duct 12 in which a slotted lever 29 is rigidly fixed to a pin 30. The pin 30 is housed in a leak proof box 31. The slotted lever 29 engages a pin 32 which is fixed to the bottom duct 12. The slotted lever 29 is inserted through a window 33 and, as can be seen, the control of the bottom duct 12 is accomplished by moving the lever 20. Although FIG. 9 illustrates the slotted lever 29 type mechanism with a buffer gas entry at the bottom side of a transfer port 21*a* at the end of the passage 21, it is to be understood that the present invention is not so limited and may be used with other types of designs.

Figure 10:
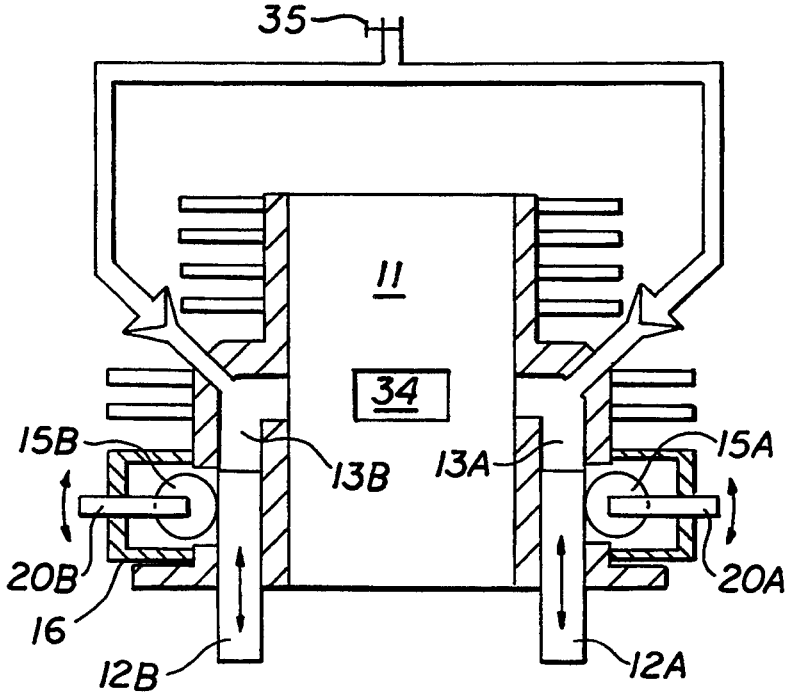
FIG. 10 is a sectional view of the cylinder block with two transfer passages, on either side of the exhaust port, that has variable volume ducts in each of the ducts in accordance with the present invention and a non-return valve for admitting fresh air from the atmosphere through a common regulating valve.

FIG. 10 illustrates a design wherein the cylinder block has two transfer passages 13*a* and 13*b* on either side of an exhaust port 34. Accordingly, in FIG. 10 there are two bottom ducts 12*a* and 12*b*, one in each of the transfer passages 13*a* and 13*b*, respectively. To operate each of the bottom ducts 12*a* there are two pinions 15*a* and 15*b* associated with each of the racks (not shown) on the bottom ducts 12b operatively attached to the levers 20*a* and 20*b* as explained above. The operation of the system to vary the transfer duct volume is similar to the one explained earlier. Notice that in the case of two transfer passages, the induction of buffer gas, air in this case, is regulated by means of a single valve 35.

Figure 11:
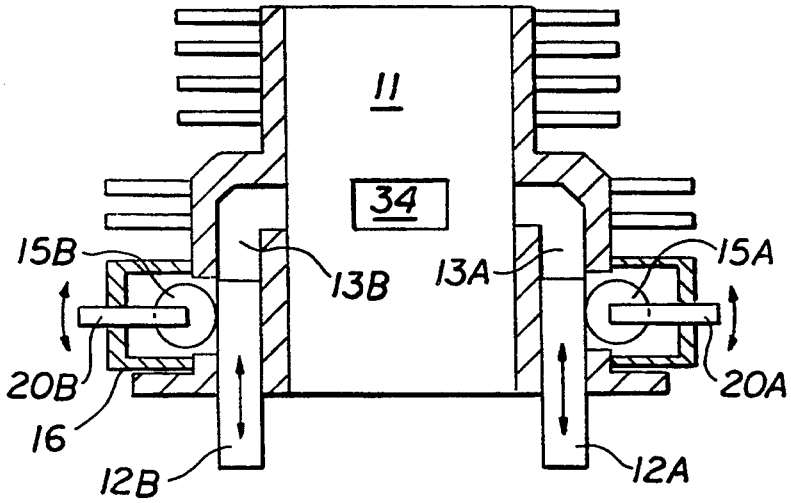
FIG. 11 is a sectional view of a conventional cylinder block with two continuously variable transfer passages in accordance with the present invention.

FIG. 11 illustrates a conventional type cylinder block without any provision for introduction of outside buffer gas. The continuously variable volume transfer duct in this case helps to tune the duct as per the load condition. At lighter loads, a shorter duct length is preferred to improve the flow characteristics of fresh charge from the crankcase chamber (not shown) to the combustion chamber 11. At some operating points an exhaust pressure wave may travel to the air/fuel inlet duct (not shown) and may effect the intake characteristics. Therefore, a continuously tunable transfer duct is better than a fixed length transfer duct.

Note that the continuously variable volume transfer duct of the present invention is not limited to a single transfer duct or two ducts. It may be used in auxiliary scavenging passages also. It is to be understood that the transfer duct may also referred to as scavenging passage or transfer passage.

The exemplary embodiments of the present invention constitute some practical embodiments of the invention, however the claimed invention is not limited strictly to the exact details illustrated herein since it can be considerably varied without departing from the spirit of the invention. While the invention has been shown in connection with a preferred embodiment, it is not the intention that the invention be so limited. Rather, the invention extends to all such designs and modifications as come within the scope of the appended claims.

We claim:

1. A two-stroke internal combustion engine having a transfer passage which comprises a first duct and a second duct, the length of the transfer passage being variable, by a control means which cause the first duct to slide inside the second duct, in order to vary the volume of the transfer duct according to operating conditions of the engine.

2. The engine according to claim 1 further comprising a means to flow buffer gas into said ducts wherein said buffer gas is exhaust gas from the engine.

3. The engine according to claim 1 further comprising a means to flow buffer gas into said ducts wherein said buffer gas is fresh air.

4. The engine according to claim 1 wherein said control means is operable to vary the volume of the transfer duct according to an engine load condition.

5. The engine according to claim 1 wherein said first duct is a lower duct and said second duct is an upper duct and said engine further comprises a means to induct buffer gas into a top entrance of said transfer passage.

6. The engine according to claim 5 wherein said control means includes a means to induct buffer gas into said transfer passage through piston controlled ports.

7. The engine according to claim 5 wherein said control means includes a valve means to regulate buffer gas inducted into said transfer passage.

8. The engine according to claim 1 further comprising a rack and pinion actuation means to slide said first duct within said second duct, said actuation means having a rack attached to said first duct and a pinion engaging said rack.

9. The engine according to claim 8 wherein said actuation means further comprises a geared rack on an outer surface of said first duct, said pinion is generally disposed outside of a cylinder block of the engine and engages said rack through a window in said cylinder block, and said pinion is rotatable against a spring and operably linked through suitable linkages to an actuator which is operable to apply a force to said linkages in order to slide said first duct within said second duct.

10. The engine according to claim 4 wherein said control means is operable to regulate the buffer gas according to engine load conditions such that it provides a larger amount of buffer gas at higher engine loads and a lesser quantity of buffer gas at lighter engine loads.

* * * * *